US008682191B2

(12) United States Patent
Watanabe et al.

(10) Patent No.: US 8,682,191 B2
(45) Date of Patent: Mar. 25, 2014

(54) IMAGE FORMING APPARATUS WITH CONTROLLABLE FIXING PRESSURE AND COMPUTER-READABLE MEDIUM STORED WITH IMAGE FORMING PROGRAM

(75) Inventors: Shinya Watanabe, Kanagawa (JP); Tetsuya Sonoda, Tokyo (JP); Hirotaka Udagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 289 days.

(21) Appl. No.: 13/159,003

(22) Filed: Jun. 13, 2011

(65) Prior Publication Data

US 2012/0114353 A1 May 10, 2012

(30) Foreign Application Priority Data

Nov. 5, 2010 (JP) ..... 2010-248387

(51) Int. Cl.
*G03G 15/20* (2006.01)
*H05B 11/00* (2006.01)

(52) U.S. Cl.
USPC ..... 399/67; 399/33; 399/122; 399/328; 219/216

(58) Field of Classification Search
USPC ..... 399/33, 37, 329, 67; 219/216
See application file for complete search history.

(56) References Cited

U.S. PATENT DOCUMENTS

| | | | | |
|---|---|---|---|---|
| 6,347,201 | B1 * | 2/2002 | Sano et al. | 399/67 |
| 2007/0025750 | A1 * | 2/2007 | Ando | 399/67 |
| 2010/0046995 | A1 * | 2/2010 | Nakamura et al. | 399/328 |
| 2010/0074643 | A1 * | 3/2010 | Moriguchi | 399/69 |

FOREIGN PATENT DOCUMENTS

| | | | | |
|---|---|---|---|---|
| JP | 10010912 A | * | 1/1998 | G03G 15/20 |
| JP | 2007101861 A | * | 4/2007 | |
| JP | 2008-058365 A | | 3/2008 | |

* cited by examiner

*Primary Examiner* — David Gray
*Assistant Examiner* — Francis Gray
(74) *Attorney, Agent, or Firm* — Sughrue Mion, PLLC

(57) ABSTRACT

There is provided an image forming apparatus including: a forming section that, based on image forming data including image data of an image to be formed on paper and paper data relating to the paper, forms a toner image according to the image data on paper; a fixing section that fixes the toner image formed on the paper; a switching section that on operation switches a fixing pressure of the fixing section; a control section that, when the fixing pressure is switched by the switching section from a first fixing pressure to a second fixing pressure prior to a predetermined condition being satisfied after the fixing pressure has been switched to the first fixing pressure by the switching section, controls to prohibit image forming on paper corresponding to the second fixing pressure different from the first fixing pressure.

10 Claims, 8 Drawing Sheets

FIG.7

FIXING MODE IS CURRENTLY RESERVED
(IN ENVELOPE MODE)
PLEASE RETURN LEVER TO ENVELOPE MODE

FIG.8

FIXING MODE DOES NOT MATCH PAPER.
PLEASE OPERATE LEVER AND SWITCH
BACK TO ENVELOPE MODE

IMAGE FORMING APPARATUS WITH CONTROLLABLE FIXING PRESSURE AND COMPUTER-READABLE MEDIUM STORED WITH IMAGE FORMING PROGRAM

CROSS-REFERENCE TO RELATED APPLICATION

This application is based on and claims priority under 35 USC 119 from Japanese Patent Application No. 2010-248387 filed on Nov. 5, 2010.

BACKGROUND

Technical Field

The present invention relates to an image forming apparatus and to a storage medium stored with an image forming program.

SUMMARY

According to an aspect of the invention, there is provided an image forming apparatus including:

a forming section that, based on image forming data including image data of an image to be formed on paper and paper data relating to the paper, forms a toner image according to the image data on paper;

a fixing section that fixes the toner image formed on the paper;

a switching section that on operation switches a fixing pressure of the fixing section;

a control section that, when the fixing pressure is switched by the switching section from a first fixing pressure to a second fixing pressure prior to a predetermined condition being satisfied after the fixing pressure has been switched to the first fixing pressure by the switching section, controls to prohibit image forming on paper corresponding to the second fixing pressure different from the first fixing pressure.

BRIEF DESCRIPTION OF THE DRAWINGS

Exemplary embodiments of the present invention will be described in detail based on the following figures, wherein:

FIG. 7 illustrates an example of a warning message; and

FIG. 8 illustrates an example of a warning message.

DETAILED DESCRIPTION

Explanation follows regarding an exemplary embodiment of the present invention.

Figure 1:
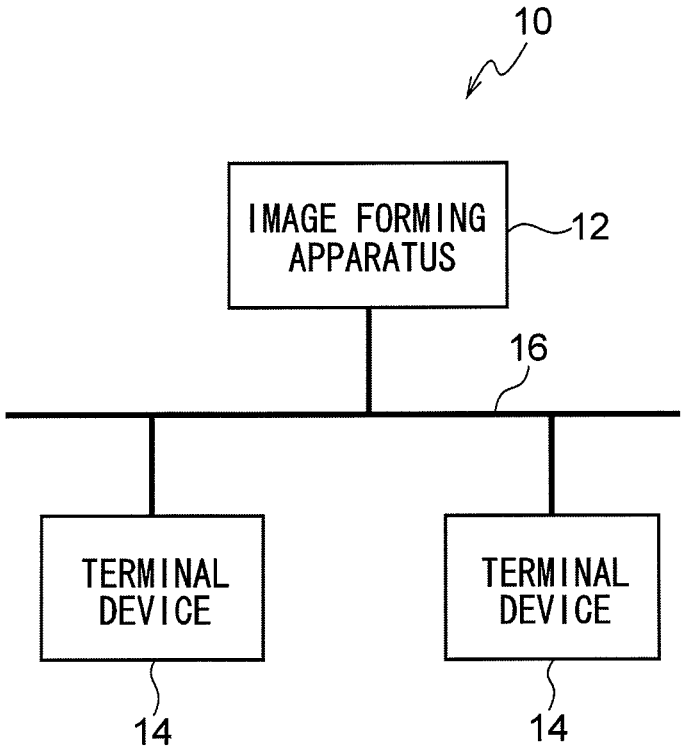
FIG. 1 is a schematic configuration diagram of an image forming system.

FIG. 1 is a schematic configuration diagram of an image forming system 10 according to the present exemplary embodiment. As shown in FIG. 1, the image forming system 10 is configured with an image forming apparatus 12 and terminal devices 14 mutually connected to each other through a network 16.

Figure 2:
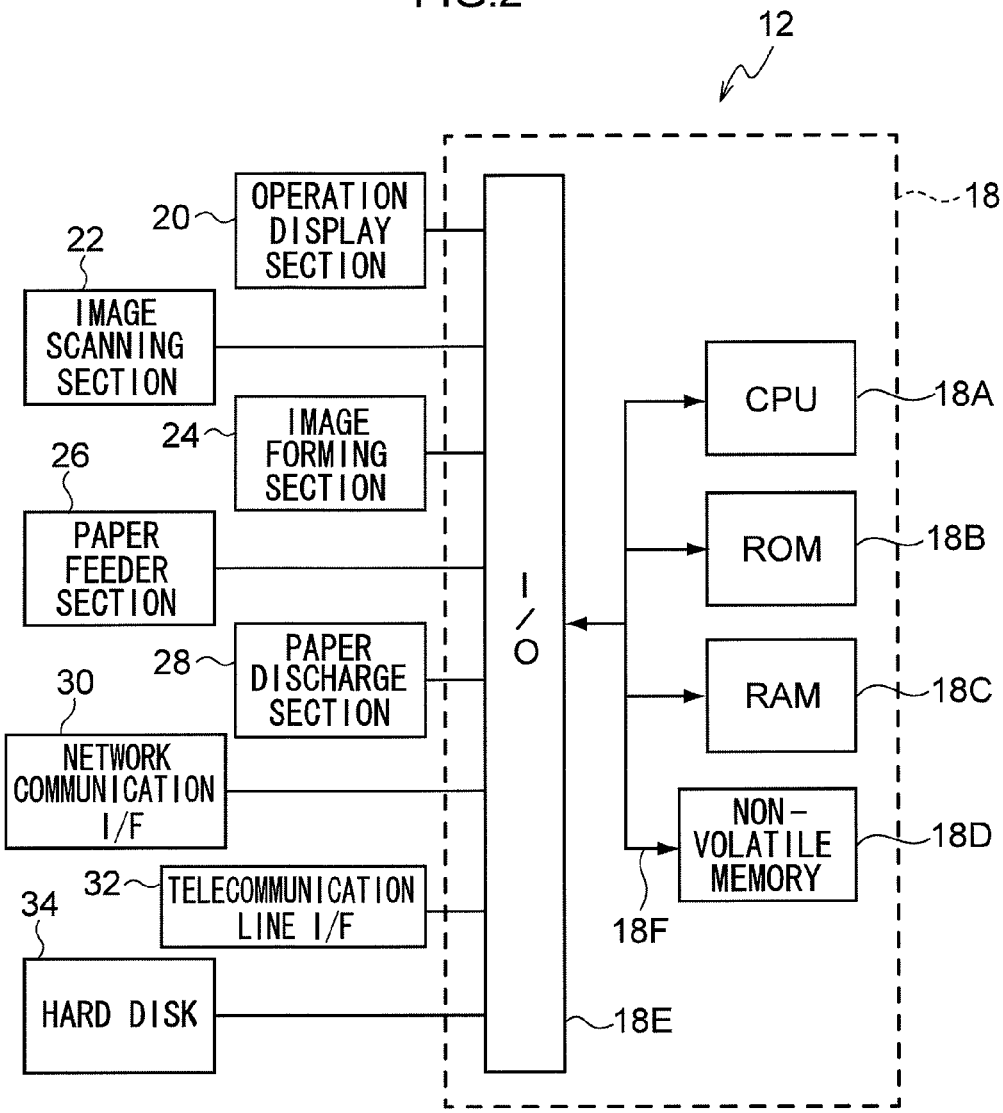
FIG. 2 is a schematic configuration diagram of an image forming apparatus.

FIG. 2 shows an example of a schematic configuration of the image forming apparatus 12. As shown in FIG. 2, the image forming apparatus 12 is configured including a computer 18.

The computer 18 is configured with a Central Processing Unit (CPU) 18A, Read Only Memory (ROM) 18B, Random Access Memory (RAM) 18C, non-volatile memory 18D, and an input-output interface (I/O) 18E, all connected together by a bus 18F. The computer 18 is also installed with internal timers, not shown in the drawings.

The I/O interface 18E is connected to each functional section, including an operation display section 20, an image scanning section 22, an image forming section 24, a paper feeder section 26, a paper discharge section 28, a network communication interface (I/F) 30, a telecommunication line interface (I/F) 32 and a hard disk 34.

The operation display section 20 is configured to include, for example, various buttons, such as a start button for instructing functions such as copy-start and a ten-key, a setting screen for setting parameters for various image forming conditions, such as copy density, and a touch panel for displaying various screens, such as an apparatus status screen.

The image scanning section 22 is configured to include an image capture sensor, such as a line CCD, and a scanning mechanism for scanning the image capture sensor. The image scanning section 22 captures an image of an original set in the apparatus.

The image forming section 24 forms an image on a recording medium using, for example, a photoelectric recording method. More specifically, the image forming section 24 is configured to include: a charging device for charging a photoreceptor drum; an exposing device for forming an electrostatic latent image according to an image on the photoreceptor drum by light-exposing the charged photoreceptor drum to light according to the image; a developing device for developing the electrostatic latent image formed on the photoreceptor drum with toner; a transfer device for transferring onto a recording medium the toner image according to the image formed on the photoreceptor drum; and a fixing device 36 for fixing the toner image according to the image that was transferred onto the recording medium, as shown in FIG. 3.

Examples of the exposing device include a light scanning device configured with a semiconductor laser, a rotating polygon mirror and an optical system including a collimator lens, a cylindrical lens and an fθ lens, as well as an LED head configured by plural LEDs.

Figure 3:
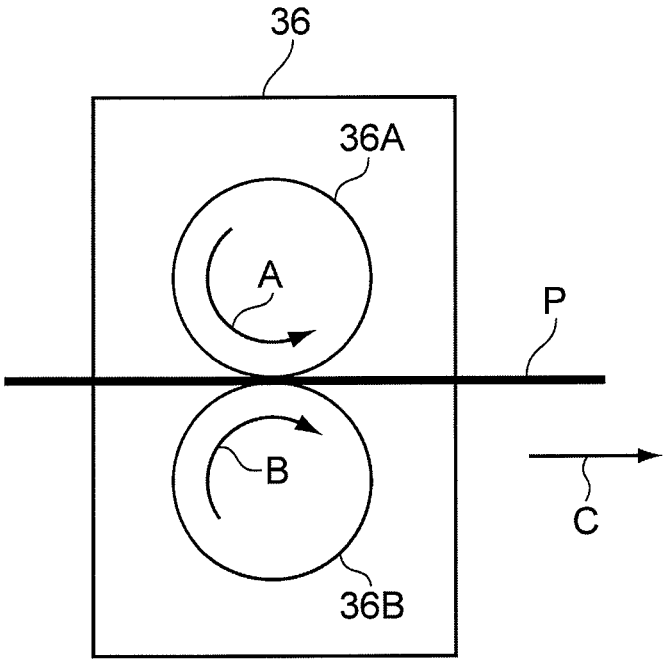
FIG. 3 is a schematic configuration diagram of a fixing device.

As shown in FIG. 3, the fixing device 36 includes, for example: a heating roll 36A that rotates in the arrow A direction of FIG. 3 and is provide with a heater, such as a halogen lamp, inside a metal core of high heat conductivity; and a pressure roll 36B disposed to face the heating roll 36A and rotating in the arrow B direction of FIG. 3. Paper P formed with the toner image according to an image is conveyed in the arrow C direction nipped between the heating roll 36A rotating in the arrow A direction of FIG. 3 and the pressure roll 36B rotating in the arrow B direction of FIG. 3. The toner image formed on the paper P is thereby heated and fixed.

Figure 4A:
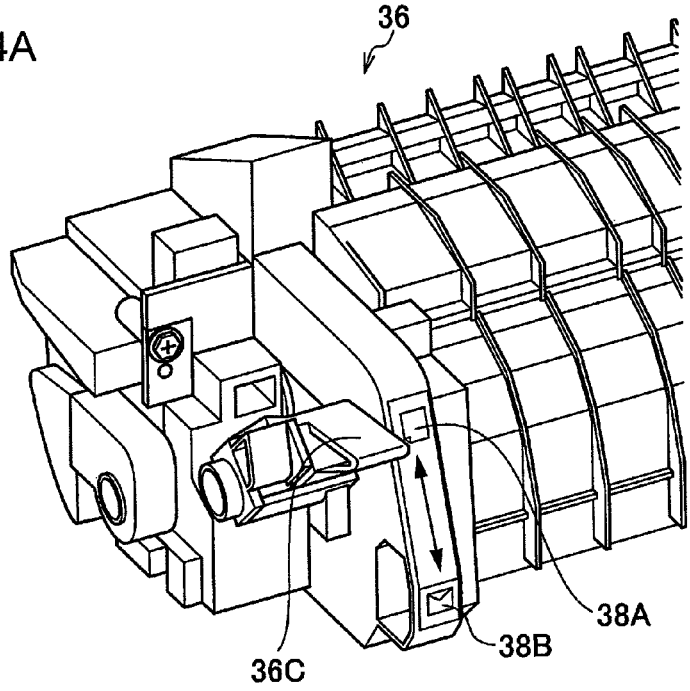
FIG. 4A is a perspective view illustrating part of the external appearance of a fixing device, showing the fixing device in a state switched to normal mode.
Figure 4B:
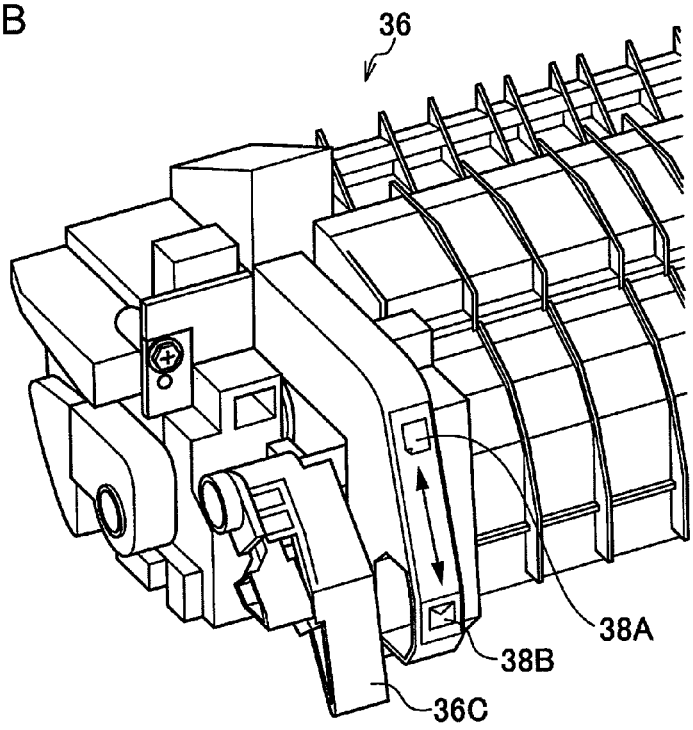
FIG. 4B is a perspective view illustrating part of the external appearance of a fixing device, showing the fixing device in a state switched to envelope mode.

The fixing device 36 is configured capable of switching between a first fixing pressure and a second fixing pressure for the fixing pressure applied to fix the toner image to the paper P, namely for the pressure of the pressure roll 36B against the heating roll 36A. The first fixing pressure is, for example, a fixing pressure appropriate for fixing a toner image formed on commonly used paper, such as plain paper. The second fixing pressure is a fixing pressure appropriate for fixing a toner image formed, for example, on an envelope which, in contrast to plain paper, might be creased if fixed with the first fixing pressure. The second fixing pressure is lower than the first fixing pressure. In the present exemplary embodiment, for example, the first fixing pressure is set as the pressure for fixing on paper other than envelopes, such as plain paper, and the fixing mode for fixing with the first fixing pressure is called the normal mode. The second fixing pressure is set as the pressure for fixing to envelopes and the fixing mode for fixing with the second fixing pressure is called the envelope mode FIG. 4A and FIG. 4B are perspective views of portions of the external appearance of the fixing device 36. As shown in FIG. 4A, the fixing device 36 includes a switching lever 36C for switching the fixing pressure. When the switching lever 36C is positioned at a mark 38A indicating plain paper then this switches the state of the fixing device 36 to the normal mode, namely switched so as to fix with the first fixing pressure. However, when, as shown in FIG. 4B, the switching lever 36C is positioned at the mark 38B indicating envelopes then this switches the state of the fixing device 36 to the envelope mode, namely switched so as to fix with the second fixing pressure lower than the first fixing pressure.

The fixing device 36 is hence cooperated to switching operation by a user of the switching lever 36C, thereby achieving a configuration in which the pressure with which the pressure roll 36B presses the heating roll 36A is switchable. Note that the positions of the switching lever 36C are detected by a sensor, not shown in the drawings, and data indicating the position of the switching lever 36C is, for example, stored in a memory, not shown in the drawings, within the image forming section 24. Data related to the current position of the switching lever 36C is acquired by the CPU 18A interrogating the image forming section 24 for the data indicating the position of the switching lever 36C.

The switching lever 36C is switched to the envelope mode when a user wishes to print on an envelope, and the switching lever 36C is switched to normal mode when a user wishes to print on other paper than envelopes, such as plain paper. A print instruction is then sent from each of the terminal devices 14 or a copy instruction is instigated on the operation display section 20. The toner image is accordingly fixed with the fixing pressure appropriate for the respective types of paper.

The paper feeder section 26 is configured to include a paper storage section for storing recording paper and a feeder mechanism for feeding the recording paper from the paper storage section to the image forming section 24. The paper storage section is provided with plural housing sections, such as a housing section for storing plain paper, and a housing section for storing envelopes.

The paper discharge section 28 is configured to include a finisher, for performing post-processing on the recording paper, such as stapling, hole punching and the like, a discharge section into which the recording paper is discharged, and a discharge mechanism for discharging the recording paper formed with an image in the image forming section 24 into the finisher or onto the discharge section.

The network communication I/F 30 is an interface for data transmission to the terminal devices 14 through the network 16.

The telecommunication line I/F 32 is an interface for performing facsimile communication with another image forming apparatus connected through a telecommunications line, not shown in the drawings.

The hard disk 34 stores, for example, log data of the status and operation conditions of each section of the apparatus, log data of the processing results of copying, facsimile communication and printing, various setting data, and a control program.

A control program for processing, described later, is pre-stored, in the hard disk 34 in the example of the present exemplary embodiment, and is executed by the CPU 18A reading in the pre-stored control program. A configuration may also be implemented in which the control program is stored on a recording medium, such as a CD-ROM, and the control program executed by reading in with a CD-ROM drive.

Each of the terminal devices 14 is, for example, configured with a general purpose personal computer, and transmits image forming data including image data related to the image to be formed on the paper and paper data related to the type of paper, to the image forming apparatus 12 when printing is instructed by a user. The paper data is data to instruct the type of paper, such as plain paper or envelope. "Image" in the present exemplary embodiment includes various forms of image, such as images composed entirely of text and images including photographs and graphics.

A user switches the switching lever 36C to envelope mode when a user wishes, for example, to print an address on an envelope, and a user switches the switching lever 36C to the normal mode when a user wishes to print on paper other than envelopes, such as plain paper. Either envelope or plain paper is designated in the paper data from the terminal device 14, and a print instruction is given by transmitting the paper data together with the image data to the image forming apparatus 12 over the network 16.

On receipt of the image forming data transmitted from one of the terminal devices 14 through the network 16 and including the image data and the paper data, the image forming apparatus 12 forms an image on the designated paper based on the received image forming data.

On receipt of image forming data from another device over a telecommunication line by facsimile transmission, the image forming apparatus 12 forms an image on the designated paper based on the received image forming data.

When a user has set an original in the image scanning section 22 and has designated the type of paper by operating the operation display section 20, the image forming apparatus 12 forms the image of the original scanned by the image scanning section 22 onto the designated paper.

Figure 5:
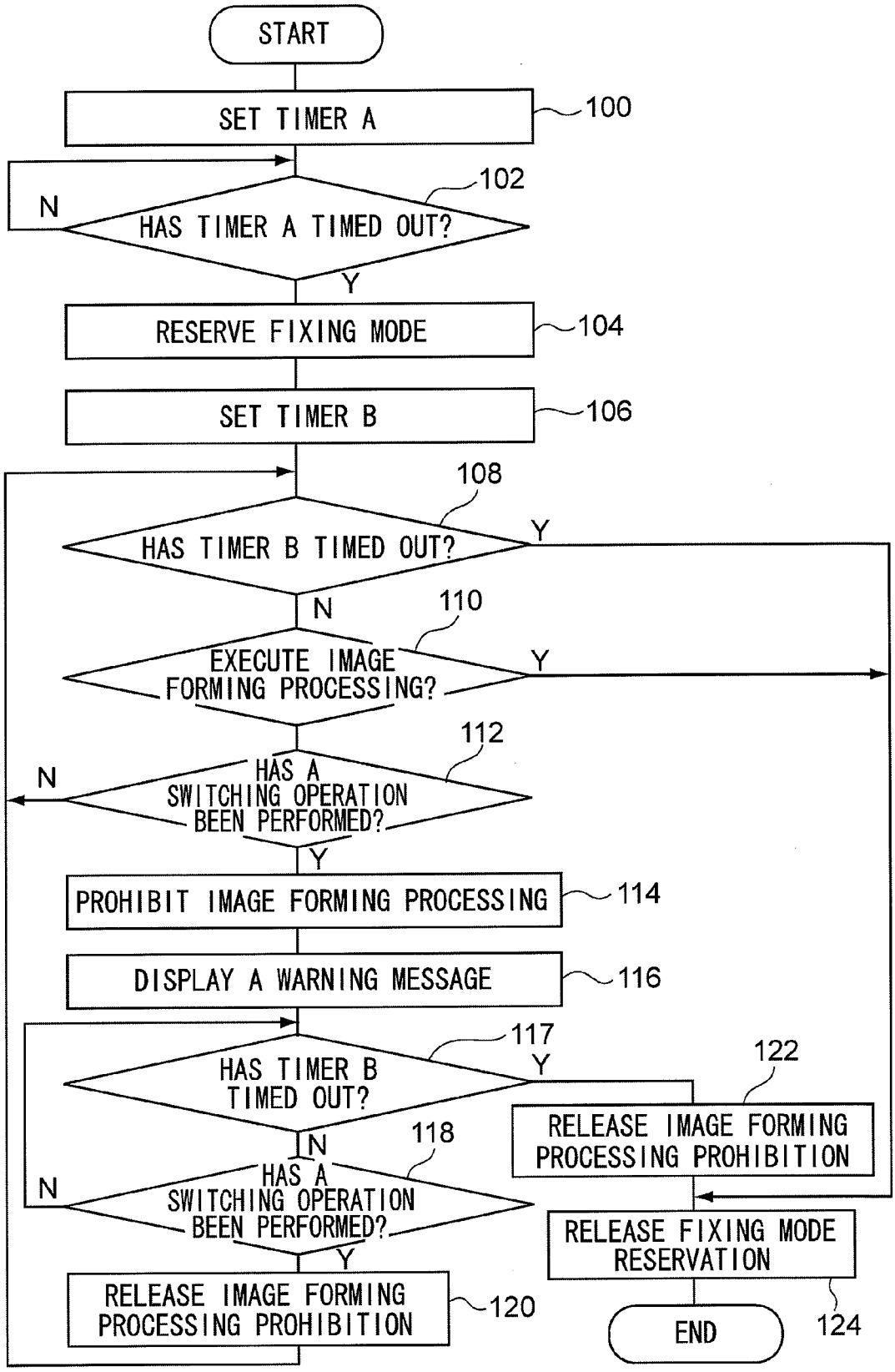
FIG. 5 is a flow chart of processing executed by the image forming apparatus.
Figure 6:
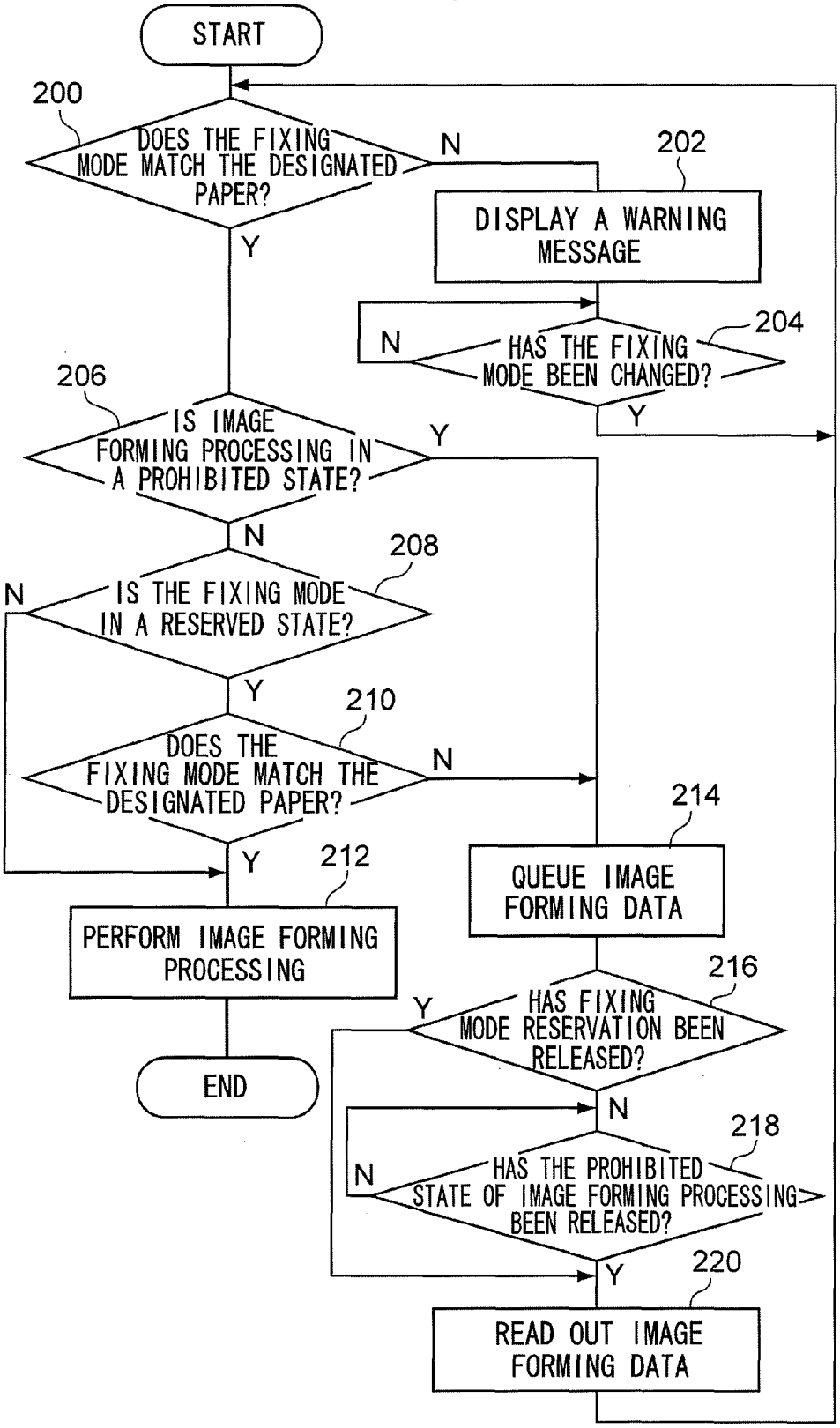
FIG. 6 is a flow chart of processing executed by the image forming apparatus.

Explanation now follows regarding processing executed by the CPU 18A of the image forming apparatus 12 in operation of the present exemplary embodiment, with reference to the flow charts of FIG. 5 and FIG. 6.

First explanation follows regarding processing when the switching lever 36C is operated, with reference to the flow chart illustrated in FIG. 5.

This processing is executed when the switching lever 36C has been operated by a user.

First, at step 100, a timer A is set and counting started. The value set in the timer A is, for example, set as a value that can be determined by the time required to elapse from when the switching lever 36C is first operated to ensure that the switching lever 36C has been completely switched over.

At step 102, determination is made as to whether or not the timer A has timed out, namely whether or not the set duration has elapsed. Transition is made to standby if not timed out, until time out occurs. Processing proceeds to step 104 if timed out.

The current fixing mode is reserved at step 104. More specifically, a fixing mode reservation flag indicating whether or not the fixing mode has been reserved is switched on. A more detailed explanation follows, however, by reserving a fixing mode, switching of the fixing mode is prohibited until a predetermined reservation duration has elapsed from when the switching lever 36C was switched over.

A timer B is set at step 106 and counting started. The value set in the timer B is, for example, a predetermined reservation duration as the period of time, from when the fixing mode was reserved, during which changing the fixing mode is prohibited.

At step 108, determination is made as to whether or not the timer B has timed out. Processing proceeds to step 110 if not yet timed out, and proceeds to step 124 if timed out.

The reservation on the fixing mode is released at step 124. Namely, the fixing mode reservation flag is switched off. This enables the fixing mode to be switched.

Determination is made at step 110 as to whether or not there has been an instruction issued to execute image forming processing on the paper corresponding to the fixing mode that has been switched to. For example, determination is made as to whether or not image forming data for the paper corresponding to the current fixing mode has been transmitted from one of the terminal devices 14 and printing has been instructed, or whether or not a user has set an original has been set in the image scanning section 22, selected the paper corresponding to the current fixing mode and instructed copying by operating the operation display section 20.

When image forming processing execution has been instructed, for example when printing or copying has been instructed, processing proceeds to step 124, and when image forming processing execution has not been instructed processing proceeds to step 112.

At step 112 determination is made as to whether or not the switching lever 36C has been operated and the fixing mode switched. Processing proceeds to step 114 if the fixing mode has been switched, and processing returns to step 108 if the fixing mode has not been switched, and the above processing is then repeated.

At step 114, the image forming processing prohibition flag indicating whether or not image forming processing is prohibited is switched on.

At step 116, a warning message like that shown in FIG. 7 is displayed on the operation display section 20 to prompt a user to return the fixing mode to its original position. In the example shown in FIG. 7, the current fixing mode is the envelope mode, and the message indicates that the switching lever 36C needs to be returned to the envelope mode. By displaying such a warning message on the operation display section 20 a user can ascertain that the fixing mode should be restored, and then operate the switching lever 36C to return the fixing mode to its original position. Configuration may also be made such that display is by displaying a warning message on the terminal device 14 for cases in which printing is instructed from one of the terminal devices 14.

Determination is made at step 117 as to whether or not the timer B has timed out. Processing proceeds to step 118 if timed out, and processing proceeds to step 122 if not yet timed out.

The prohibition flag is switched off at step 122 since the timer B has timed out, and the fixing mode reservation flag is then switched off in step 124. The state prohibiting image forming processing and the fixing mode reservation state are thereby released.

However, at step 118 determination is made as to whether the switching lever 36C has been operated and the fixing mode returned to its original state. Processing proceeds to step 120 if the fixing mode has been returned and processing proceeds to step 117 if the fixing mode has not yet been returned.

When the switching lever 36C has been operated by a user and the fixing mode switched, switching of the fixing mode is accordingly prohibited until the timer B has timed out. Consequently instances can be avoided when, for example, the switching lever 36C has been operated by one user and the fixing mode switched, but the fixing mode is then switched again by another user during the interval in which the first user returns to each of the terminal devices 14 and instructs image forming processing.

Note that while the present routine is executed when the switching lever 36C has been operated by a user, suppose this operation had occurred unintentionally, even if the switching lever 36C was to be returned to its original position, image forming would still be prohibited until timer B has timed out since determination is still affirmative at step 112. Configuration may accordingly be made such that the image forming prohibited state is released by operation from the operation display section 20 to release the image forming prohibited state, or by instructing release of the image forming prohibited state from the terminal device 14.

Explanation now follows of processing when image forming processing has been instructed, with reference to the flow chart in FIG. 6.

The processing illustrated in FIG. 6 is executed, for example, when image forming data has been transmitted from one of the terminal devices 14 and printing instructed, when a user has set an original in the image scanning section 22 and instructed copying by operating the operation display section 20.

At step 200, determination is made as to whether or not the paper corresponding to the current fixing mode matches the paper designated in the paper data. More specifically, data indicating the position of the switching lever 36C is acquired from the image forming section 24 and determination is made based on this data as to whether or not the current fixing mode is the normal mode or the envelope mode. Determination is then made as to whether or not the paper corresponding to the fixing mode matches the paper designated in the paper data.

Processing proceeds to step 206 when the paper corresponding to the current fixing mode matches the paper designated in the paper data, and processing proceeds to step 202 when there is no match.

At step 202, since the paper corresponding to the current fixing mode does not match the paper designated in the paper data, a warning message like the warning message shown in FIG. 8 is displayed on the operation display section 20, prompting a user to switch the switching lever 36C. The example shown in FIG. 8 indicates that since the current fixing mode is the normal mode, and since the designated paper is an envelope, the switching lever 36C needs to be returned to the envelope mode. By displaying a warning message such as this on the operation display section 20, a user can ascertain that the fixing mode needs to be switched over to the envelope mode, and the user can operate the switching lever 36C to switch the fixing mode to the envelope mode. Configuration may also be made such that display in instructed such that a warning message is displayed on one of the terminal devices 14 when printing has been instructed from the terminal device 14.

Determination is made at step 206 as to whether or not image forming processing is in the prohibited state, namely whether or not the image forming processing prohibition flag is on. Processing proceeds to step 214 if the image forming processing prohibition flag is on, and processing proceeds to step 208 if the image forming processing prohibition flag is off.

At step 208, determination is made as to whether or not the fixing mode is in a reserved state, namely determination is made as to whether or not the fixing mode reservation flag is on. Processing proceeds to step 210 if the fixing mode reservation flag is on, and processing proceeds to step 212 if the fixing mode reservation flag is off.

Determination is made at step 210 as to whether or not the paper corresponding to the current fixing mode matches the paper designated in the paper data. Processing proceeds to step 212 if there is a match and processing proceeds to step 214 if there is no match.

At step 212, the image forming section 24 is instructed to form a toner image corresponding to an image on the designated paper. The toner image corresponding to an image is thereby formed on the paper.

However, when affirmative determination is made at step 206, namely when the image forming processing prohibition flag is on, determination is negative at step 210, namely the paper corresponding to the current fixing mode does not match the paper designated in the paper data, and so sometimes the image forming processing is not actually executed.

The image forming data of data related to the image forming instruction is hence queued at step 214. Namely, the image forming data is stored in the hard disk 34 using a first in first out protocol.

At step 214, determination is made as to whether or not the fixing mode reserved state has been released, namely determination is made as to whether or not the fixing mode reservation flag is off. Processing proceeds to step 220 if the fixing mode reservation flag is off, and processing proceeds to step 218 if the fixing mode reservation flag is on.

At step 218, determination is made as to whether or not image forming processing is in a prevented state, namely whether or not the image forming processing prohibition flag is off. Processing proceeds to step 220 if the image forming processing prohibition flag is off, and a standby state is adopted if the image forming processing prohibition flag is on until the image forming processing prohibition flag is switched off.

At step 220, the oldest queued image forming data is read from the queued image forming data in the hard disk 34, and processing then proceeds to step 200. The image forming processing that was on execution standby is thereby executed.

Note that configuration may be made such that not only is the oldest queued image forming data read from the queued image forming data in the hard disk 34, but, for example, image forming data with designated paper corresponding to the current fixing mode is also prioritized and read from the hard disk 34. Namely, configuration may be made such that the execution sequence for the queued image forming data may be changed such that the image forming data with designated paper corresponding to the current fixing mode is read first. Such cases may be configured so that the fixing mode reserved state is released when image forming has been completed for all the image forming data with designated paper corresponding to the current fixing mode. The number of times the fixing mode is switched over can thereby be limited to the minimum.

Configuration may be made such that the fixing mode reserved state is released when, out of the queued image forming data, all image forming tasks has been cancelled for image forming data of designated paper corresponding to the current fixing mode.

Configuration may also be made such that the fixing mode reserved state is released when the image forming apparatus 12 has transitioned to a power save mode for saving electricity when the image forming apparatus 12 has not been operated for a predetermined period of time or longer.

An opposite configuration may be adopted in which transition to the power save mode is prohibited when the fixing mode is in the reserved state.

Configuration may be made such that when the fixing mode has been changed in the power save mode, the power save mode is released such that the fixing mode can be placed in the reserved state.

Explanation in the present exemplary embodiment is of a case in which the fixing mode is switched between a normal mode and an envelope mode, however configuration may be made such that switching is made between three or more mode types.

The configuration (see FIG. 2) of the image forming apparatus 12 explained in each of the exemplary embodiments is merely an example thereof, and obviously sections not required may be omitted, and/or new sections added within a scope not departing from the spirit of the present invention.

The flow of processing in control programs (see FIG. 5 and FIG. 6) explained in each of the above exemplary embodiments is also merely an example, and obviously steps not required may be removed, and/or new steps added within a scope not departing from the spirit of the present invention.

What is claimed is:

1. An image forming apparatus comprising:

a forming section that, based on image forming data including image data of an image to be formed on paper and paper data relating to the paper, forms a toner image according to the image data on paper;

a fixing section that fixes the toner image formed on the paper;

a switching section that on operation switches a fixing pressure of the fixing section;

a control section that, when the fixing pressure is switched by the switching section from a first fixing pressure to a second fixing pressure before a timer times a predetermined duration after the fixing pressure has been switched to the first fixing pressure by the switching section, controls to prohibit image forming on paper corresponding to the second fixing pressure different from the first fixing pressure.

2. The image forming apparatus of claim 1, wherein the predetermined condition is such that image forming on paper corresponding to the first fixing pressure is instructed.

3. The image forming apparatus of claim 1, wherein the predetermined condition is such that a predetermined duration of time is elapsed.

4. The image forming apparatus of claim 1, wherein the predetermined condition is such that operation to cancel switching to the first fixing pressure is conducted.

5. The image forming apparatus of claim 1, wherein the control section controls such that:

subsequent image forming data is stored in a storage section when image forming with the image forming data is instructed while image forming is in a prohibited state; and image forming is executed with the subsequent image forming data stored in the storage section when image forming has been released from the prohibited state.

6. The image forming apparatus of claim 5, wherein the control section controls such that image forming with the subsequent image forming data with designated paper corresponding to the current fixing pressure is given priority for execution when there are a plurality of the subsequent image forming data jobs stored in the storage section.

7. A non-transitory computer-readable medium storing an image forming program that is executable to make a computer function as the switching section and the control section configuring the image forming apparatus of claim 1.

8. An image forming apparatus comprising:

a forming section that, based on image data of an image to be formed and paper type data indicating a type of paper, forms a toner image according to the image data on the paper;

a fixing section that fixes the toner image formed on the paper according to a first fixing pressure corresponding to a first type of paper, or a second fixing pressure corresponding to a second type of paper;

a switching section that switches a fixing pressure of the fixing section from the first fixing pressure to the second fixing pressure and vice versa;

a control section that determines whether the type of the paper indicated by the paper type data matches the type of paper corresponding to the fixing pressure set by the switching section, and when the type of paper does not match, controls to prohibit image forming on the paper, and when the type of paper matches, controls to enable image forming on the paper.

9. The image forming apparatus according to claim 8, further comprising a display panel, wherein when the type of paper does not match, the control section controls to display a warning message on the display panel.

10. The image forming apparatus according to claim 8, further comprising a storage, wherein when the type of paper does not match, the control section stores the image data in the storage until the fixing pressure set by the switching section is switched such that the type of the paper indicated by the paper type data matches the type of paper corresponding to the fixing pressure set by the switching section, and then reads the image data and controls to enable image forming on the paper.

* * * * *